United States Patent [19]

Miller

[11] 4,432,481

[45] Feb. 21, 1984

[54] SPLICE-IN-REGISTER CONTROL

[75] Inventor: Peter S. Miller, Toledo, Ohio

[73] Assignee: Owens-Illinois, Inc., Toledo, Ohio

[21] Appl. No.: 388,320

[22] Filed: Jun. 14, 1982

[51] Int. Cl.[3] ..... B65H 25/00

[52] U.S. Cl. ..... 226/9; 226/28

[58] Field of Search ..... 226/9, 24, 27, 28, 29, 226/33; 318/66, 68, 69, 309, 310–313; 156/361–363, 541, 542, 98

[56] References Cited

U.S. PATENT DOCUMENTS

| | | | |
|---|---|---|---|
| 3,589,095 | 6/1971 | James et al. | 226/29 X |
| 4,019,935 | 4/1977 | Harvey | 156/64 |
| 4,082,589 | 4/1978 | Patterson et al. | 156/98 |
| 4,316,566 | 2/1982 | Arleth et al. | 226/28 |
| 4,381,211 | 4/1983 | Nechay | 156/361 |

*Primary Examiner*—Leonard D. Christian

*Attorney, Agent, or Firm*—Gerald T. Welch; Myron E. Click

[57] ABSTRACT

A web-feeding machine used to provide a continuous supply of material having successive labels and registration marks printed serially thereon includes an assembly for splicing the material from a ready web to the material severed from a running web. The splicing assembly has a response time T after being actuated by a control system. The control system comprises a driving circuit for electromechanically actuating the splicing assembly, a scanner positioned adjacent the material to provide a signal in response to the presence of a registration mark, and an encoder for providing a fixed number of pulses proportional to a corresponding length of the moving material. The control system also comprises a control circuit connected to the scanner, the encoder and the driving circuit. The control circuit counts the number of encoder pulses $B_o$ between successive scanner signals and then decrements from that number $B_o$ to zero. In addition, the control circuit provides a time delay $T_o$ preset to approximate the response time T and then decrements to zero from a preset number D after the time delay $T_o$ has expired. When the control circuit reaches zero, it stores a decremented value X representing the contemporaneous number read while decrementing from $B_o$ to zero. The control circuit then decrements from the value X and provides a splice signal SS upon reaching zero. Finally, the driving circuit energizes the splicing assembly in response to the splice signal SS to accomplish a splice-in-register.

13 Claims, 7 Drawing Figures

GENERATION OF SPLICE SIGNAL (SS)

SPLICE-IN-REGISTER CONTROL

FIELD OF THE INVENTION

This invention relates to controlling a web-feeding machine to splice material from one web to material from another in-register, and more particularly to a method, apparatus and system therefor.

BACKGROUND OF THE INVENTION

A web-feeding machine comprises a base framework and a pair of turntables suitably journalled thereon for rotation in a horizontal plane. Each turntable supports a web of material. Typically, the material is being supplied from one web, a running web, while material from the other web stands ready to be spliced to the running material when the running web is nearly spent. The ready material is "spliced" to the running material by a splicing assembly which overlaps and attaches the running material of the ready material and severs the running material from the running web. The two turntables are used alternately to provide a continuous supply of material to the festoon of a label-cutting apparatus. A splice-in-register control is electronically connected to the web-feeding machine to provide a splice-command signal to actuate the splicing assembly, taking into account the specific response time T associated with the splicing assembly which causes a delay before the splice is accomplished. A plurality of labels and corresponding registration marks are printed serially on the material. A registration mark is a readable index mark for each label printed on a contrasting background whereas a "whiteout" is a region on the label where there is no printing. In operation, the splice must also occur "in-register," i.e., the running material must overlap the ready material so that the label of the running material coincides or is in phase with the first label at the end of the ready material. The splice-command signal is provided by the control to compensate for the response time of the splicing mechanism so that the labels are in-register.

A whiteout usually appears at the end of the material when the web is nearly expanded. However, a whiteout can occur anywhere along the material if there had been a printing problem. In either case, the operator must shut down the machine. This involves a loss of production time and a loss of material. Although there are controllers that can accomplish a splice-in-register, they typically can do so only for material having labels of a specific length printed thereon and moving at a fixed speed through the machine, such as, for example, the auto sequence controller which has been available from the Champion Edison Company located in Edison, N.J. These requirements made the solution as costly as the problem itself. Furthermore, the operator had to determine when to enable the splice-command signal since these past controllers were not designed to recognize the end of the running web or an earlier printing problem by counting a predetermined number of successive whiteouts and then to automatically accomplish a splice-in-register in response thereto.

SUMMARY OF THE INVENTION

The instant invention is based on the discovery of a method, apparatus and system for controlling a web-feeding machine to splice material from one web to material from another in-register. A control system for the machine comprises a driving circuit having an input and an output electromechanically coupled to the splicing assembly actuated thereby in response to a splice-command signal SC when applied to the input thereof, a scanner positioned adjacent the material to provide a signal in response to the presence of a registration mark, and an encoder for providing a fixed number of pulses proportional to a corresponding length of the moving material. The control system also comprises a control circuit connected to the scanner, the encoder and the input of the driving circuit. The control circuit has first means for counting the number of encoder pulses $B_o$ between successive scanner signals and then for decrementing from that number to zero in response to successive encoder pulses and second means responsive to a scanner signal for providing a time delay $T_o$ preset to approximate the response time T and for decrementing to zero from a preset number D corresponding to the distance between the splicing assembly and the scanner after the time delay $T_o$ has expired. Since a fixed number of the encoder pulses is proportional to a corresponding length of moving material, the encoder provides the same number of pulses per label regardless of the speed of the material. Therefore, the $B_o$-counter measures the length of each label independently from the speed of the material moving through the machine.

The control circuit also has third means connected to the first means for storing the decremented value X contained therein when the second means reaches zero and then for decrementing from the value X to zero beginning at the next scanner signal in response to successive encoder pulses to provide a splice signal SS upon reaching zero. Additionally, the control circuit has fourth means connected to the third means for providing the splice-command signal SC to the input of the driving circuit in response to the splice signal SS when armed by an operator. The machine accomplishes a splice-in-register after the splice-command signal SC has been applied thereto. Hence, it is an object of the invention that the control circuit provides a splice-command signal SC which causes the material to be spliced in-register regardless of the length of the labels printed on the material of the speed of the material through the machine.

The control system further comprises fifth means connected to the first means for providing an enable signal if a scanner signal has been detected in a length-window where expected and sixth means connected to the first means for decrementing from a preset whiteout number each time the first means reaches zero. The sixth means is reloaded with the preset whiteout number in response to each scanner signal detected to prevent it from counting down to zero. Furthermore, the first means, second means and third means are all responsive to a scanner and enable signal. The fourth means is connected to the sixth means for providing a splice-command signal SC when the sixth means reaches zero when armed by the operator. This portion of the control circuit tallies the number of successive missing registration marks and provides a splice-command signal SC when the number of successive missing marks exceeds the preset whiteout number. In other words, it is an object of the invention that this portion of the control circuit recognizes the end of the running web where there is no printing or an earlier printing problem when the predetermined number of missing registration marks is exceeded and then automatically accomplishes a splice-in-register in response thereto.

Correspondingly, this portion of the control circuit ignores missing and spurious or extra registration marks as long as the frequency of occurrence does not exceed the preset whiteout number.

The control system further comprises timing-control means responsive to the splicing assembly and connected to the second means for comparing the time delay $T_o$ to the response T and providing an indication of the comparison to the operator. It is also an object of the invention that the timing-control means is also adjustable to change the time delay period $T_o$ so that it more closely approximates the response time T.

DETAILED DESCRIPTION OF THE INVENTION

Figure 1:
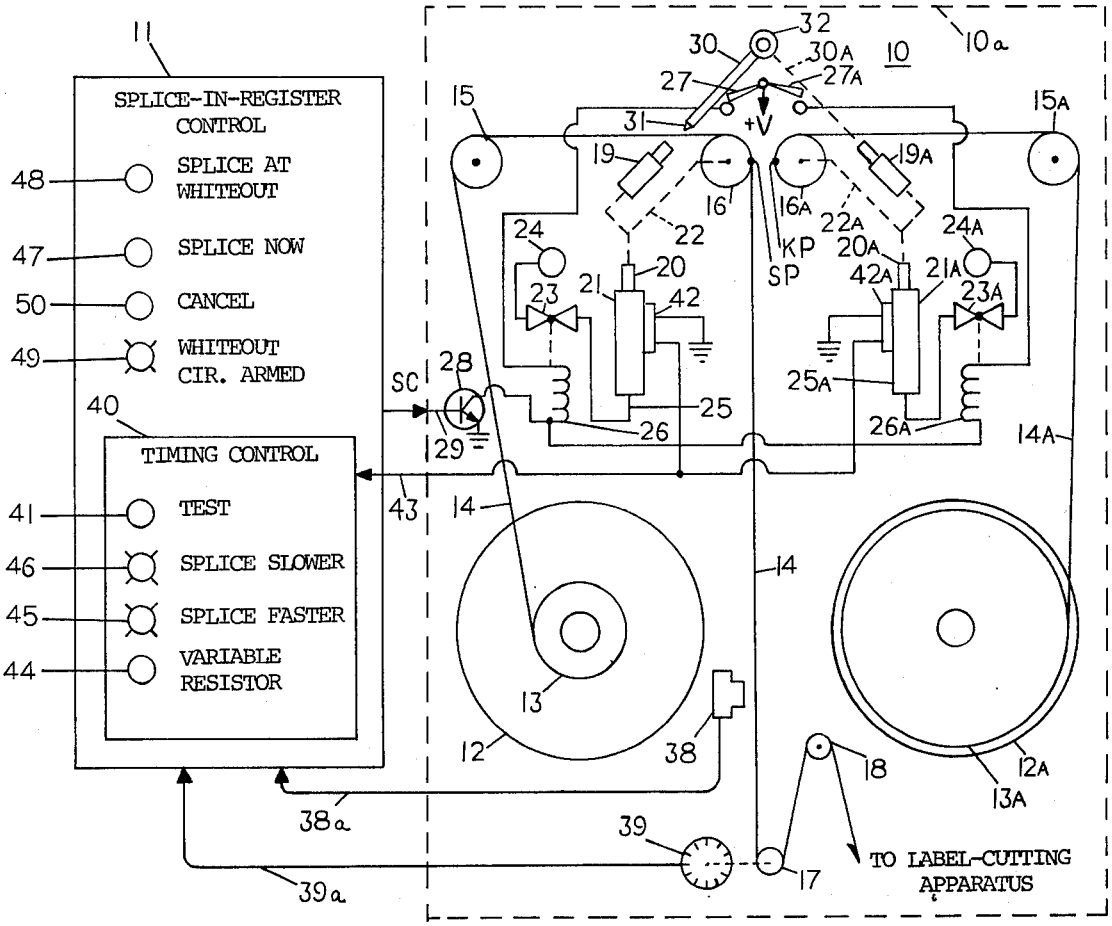
FIG. 1 is a partially schematic view of a web-feeding machine electrically connected to a splice-in-register control in accordance with the invention.

Referring to FIG. 1, a web-feeding machine is indicated generally at 10 within the dashed line 10*a* and a splice-in-register control 11 is electrically connected thereto. The machine 10 comprises a base framework (not shown) and turntables 12 and 12A suitably journalled thereon for rotation in a generally horizontal plane. Each turntable 12 and 12A supports a web 13 and 13A, respectively, of material 14 and 14A which can be, for example, a foamed polystyrene on which labels are serially printed. As shown, the material 14 is being supplied from the web 13 which is nearly expended, while the material 14A from the web 13A stands ready to be spliced to the running material 14 when the running web 13 is fully expanded. The ready material 14A is "spliced" to the running material 14 by overlapping and attaching the running material 14 to the end of the ready material 14A and severing the running material 14 from the web 13. When the running material 14 is spliced to the end of the ready material 14A, the ready web 13A becomes the running web. Thus, the two turntables 12 and 12A are used alternately to provide a continuous supply of material to the festoon of a label-cutting apparatus (not shown). Since the machine 10 uses the turntables 12 and 12A alternately, numerals used to reference the running portion of the machine 10 will also be used to described similar elements associated with the ready portion including suffix A to simplify the description.

The machine 10 further comprises a splicing assembly which includes an idler roller 15 and a kiss roller 16 over which the material 14 passes. The material 14 then travels between the two turntables 12 and 12A, around a roller 17 and over another idler roller 18 to the label-cutting apparatus. The kiss roller 16 and a brush assembly 19 are mechanically linked to a piston 20 housed in a cylinder 21 as indicates by a dashed line 22. The cylinder 21 is connected through a valve 23 to an air supply 24 by a pneumatic line 25. The brush assembly 19, the piston 20 and cylinder 21, the valve 23 and air supply 24 are all included as components of the splicing assembly. The valve 23 is actuated by a driving circuit which includes a solenoid 26 mechanically coupled to the valve 23 and serially connected through a manually-open switch 27 to a source of positive voltage V and energized through the collector-emitter junction of a transistor 28. The transistor 28 turns on to energize the solonoid 26 when a splice-command signal SC is applied to the base of the transistor 28 from the control 11 via a conductor 29. The switch 27 is closed by a cutter 30, one end of which supports a serated blade 31 and on the opposite side of the material 14 from the brush assembly 19 and the other end of which is pivotally mounted on a shaft 32 so that the cutter 30 can be manually rotated to the ready-position indicated by a dashed line 30A. The cutter 30, blade 31 and shaft 32 are also components of the splicing assembly. The ready solenoid 26A, which is also connected to the conductor 29, will not be energized by application of the splice-command signal SC until the cutter 30 is rotated to the ready-position 30A to close the ready-switch 27A. When the solenoid 26 is energized, the valve 23 connects the air supply 24 to the cylinder 21 causing the piston 20 to actuate the brush assembly 17 towards the blade 31 of the cutter 30 to sever the running material 14 from the running web 13 and to actuate the running kiss roller 16 against the ready kiss roller 16A at a kiss point KP.

In operation, a splice is accomplished as follows. An operator places a piece of double-sided tape (not shown) on the end of the ready material 14A and positions that end on the ready kiss roller 16A diametrically opposed to the running kiss roller 16 at the kiss point KP. When the control 11 provides the splice-command signal SC to the solenoid 26, it actuates the running kiss roller 16 and the brush assembly 19. After a specific response time T the splice is accomplished when the running kiss roller 16 butts against the ready kiss roller 16A at the kiss point KP causing the running material 14 to overlap and adhere to the end of the ready material 14A and when the brush assembly 19 pushes the running material 14 against the blade 31 of the cutter 30 to sever the material 14. However, it is also necessary that the splice be accomplished "in-register."

Figure 2:
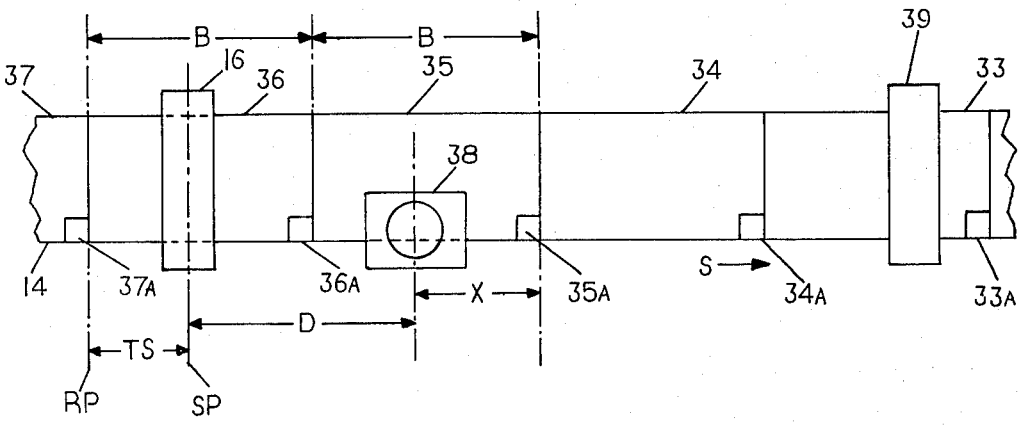
FIG. 2 is a partially schematic pictorial view of material moving through a portion of the web-feeding machine of FIG. 1 in accordance with the invention.

Referring to FIG. 2, a plurality of labels 33 through 37 and corresponding registration marks 33A through 37A are printed serially on the material 14. A registration mark is a readable index mark for each label printed on a contrasting background whereas a "whiteout" is a region on the label where there is no printing. In operation, the splice should occur "in-register," i.e., the running material 14 overlaps the ready material 14A so that the label 37 of the running material 14 coincides or is in phase with the first label of the ready material 14A. The splice-command signal SC is provided by the control 11 along the conductor 29 before a register point RP on the running material 14 has arrived at the splice point SP on the running kiss roller 16. The amount of time it takes for the register point RP to move to the kiss point KP corresponds to the response time T of the running kiss roller 16 and the brush assembly 17. For ease of explanation, the register point RP is shown as the leading end of thhe registration mark 37A. To accomplish a splice-in-register, the control 11 must determine the point SP on each label, as measured along the path of the material 14 ahead of the register point RP, at which a splice-command signal SC can be given so that the register point RP coincides with the kiss point KP when the running kiss roller 16 is fully actuated against the ready kiss roller 16A. The control 11 determines the splice-command point SP on each label by using the outputs of a scanner 38 positioned adjacent the material 14 downstream from the kiss roller 16 and an incremental encoder 39 mechanically coupled to the roller 17. The scanner 38 can be, for example, a type disclosed in U.S. Pat. No. 4,266,123 and is electrically connected to the control 11 by a wire **38*a*. The scanner 38 is designed to be responsive to the presence of a registration mark, such as registration marks 33A through 37A, as it travels within the optical view of the scanner 38. Generally, these registration marks are missing in a whiteout. The encoder 39 is a device well known in the art and provides the control 11 with a predetermined number of pulses per revolution of the roller 17 along a wire 39*a* connected therebetween. Thus, a given number of pulses is proportional to a corresponding length of the material 14 moving over the roller 17, e.g., 1000 pulses per revolution corresponding to approximately 160 pulses per inch. The splice-command point SP is determined at the target point between the kiss roller 16 and the path defined by the material 14 as it runs from the kiss roller 16 to the encoder roller 17**.

The control 11 determines the length B of each label by counting the number of encoder pulses between successive registration marks detected by the scanner 38. The distance between the register point RP and the splice-command point SP when the splice-command signal SC is given is equal to the product of the response time T of the kiss roller 16 and the speed S at which the material 14 is moving. A delay value $T_o$ equal to the response time T, is preset stored in the control 11 by the operator who uses a timing control 40 to adjust the delay time $T_o$ to more closely approximate the actual response time T. Referring back to FIG. 1, the control 40 is electrically connected to the splice-in-register control 11 when the operator presses a "test" button 41 associated with the timing control 40. The timing control 40 in responsive to either one of two normally-open read switches 42 or 42A connected in parallel thereto via a conductor 43. The switches 42 and 42A are mounted on the cylinders 21 and 21A, respectively, and are magnetically actuated by permanent magnets (not shown) mounted on the pistons 20 and 20A therein. When the piston 20 extends to fully actuate the running roller 16 to the kiss point KP, the magnetically coupled switch 42 closes. The control 11 contains an internal timer (not shown) into which the operator presets the time delay $T_o$ by manipulating a variable resistor 44 associated with the timing control 40. If the switch 42 closes before the time delay $T_o$ expires, a "splice faster" light 45 illuminates indicating that the time delay $T_o$ must be decreased so that the internal time times-out faster. If the switch 42 closes after the time delay $T_o$ expires, a "splice slower" light 46 illuminates indicating that the time delay $T_o$ must be increased so that the internal timer times-out slower. Details of the timing control 40 will be described below.

The operator must not only preset the internal timer of the control 11, but also must select the conditions under which the splice-command signal SC will be given. A splice-command signal SC will not be given unless a splice signal SS generated by the circutry of the control 11 is accomplished by a splice decision signal. A splice decision signal occurs in either of the following cases: (1) the operator has pressed a "splice-now" button 47 of the control 11 or (2) the operator has pressed a "splice-at-whiteout" button 48 of the control 11 and more than five registration marks in a row have not been sensed by the scanner 38. The splice-at-whiteout switch 48 arms a whiteout circuit (not shown) as indicated by the illumination of a "whiteout-circuit-armed" light 49. The whiteout circuit can be disarmed when the operator depresses a "cancel" button 50 associated therewith. A whiteout usually appears at the end of the material 14 when the web 13 is nearly expended. However, a whiteout can occur anywhere along the material 14 if there had been a printing problem. In either case, the operator arms the whiteout circuit when he wants the machine 10 to automatically splice the material 14 in-register a predetermined number of successive registration marks, five in the preferred embodiment, are not sensed by the scanner 38. The failure to see any registration marks while five in a row are "expected" is referred to as a "whiteout condition." Details of the splice decision circuitry will be described below.

Referring more specifically to FIG. 2, the distance between the register point RP at which the splice-command signal SC is given and the splice-command point SP is known and is equal to the product of the response time T and the speed S at which the material 14 is moving. Furthermore, the distance D between the tangent point at which splice-command point SP is determined and the center line of the scanner 38 is also fixed. Recalling that the length B of each label is calculated by the control 11, the distance X between the center line of the scanner 38 and the last registration mark 35A sensed by the scanner 38 can therefore be determined and is represented by the following equation:

$$X = NB - D - TS$$

where N is an integer representing the number of labels between the last registration mark sensed by the scanner 38 and the registration point RP. In this case, N equals two because two labels 36 and 35 fall between the last registration mark 35A sensed by the scanner 38 and the registration point RP. Determing the value of X permits a subsequent determination of the time at which the splice signal SS is given.

Figure 3:
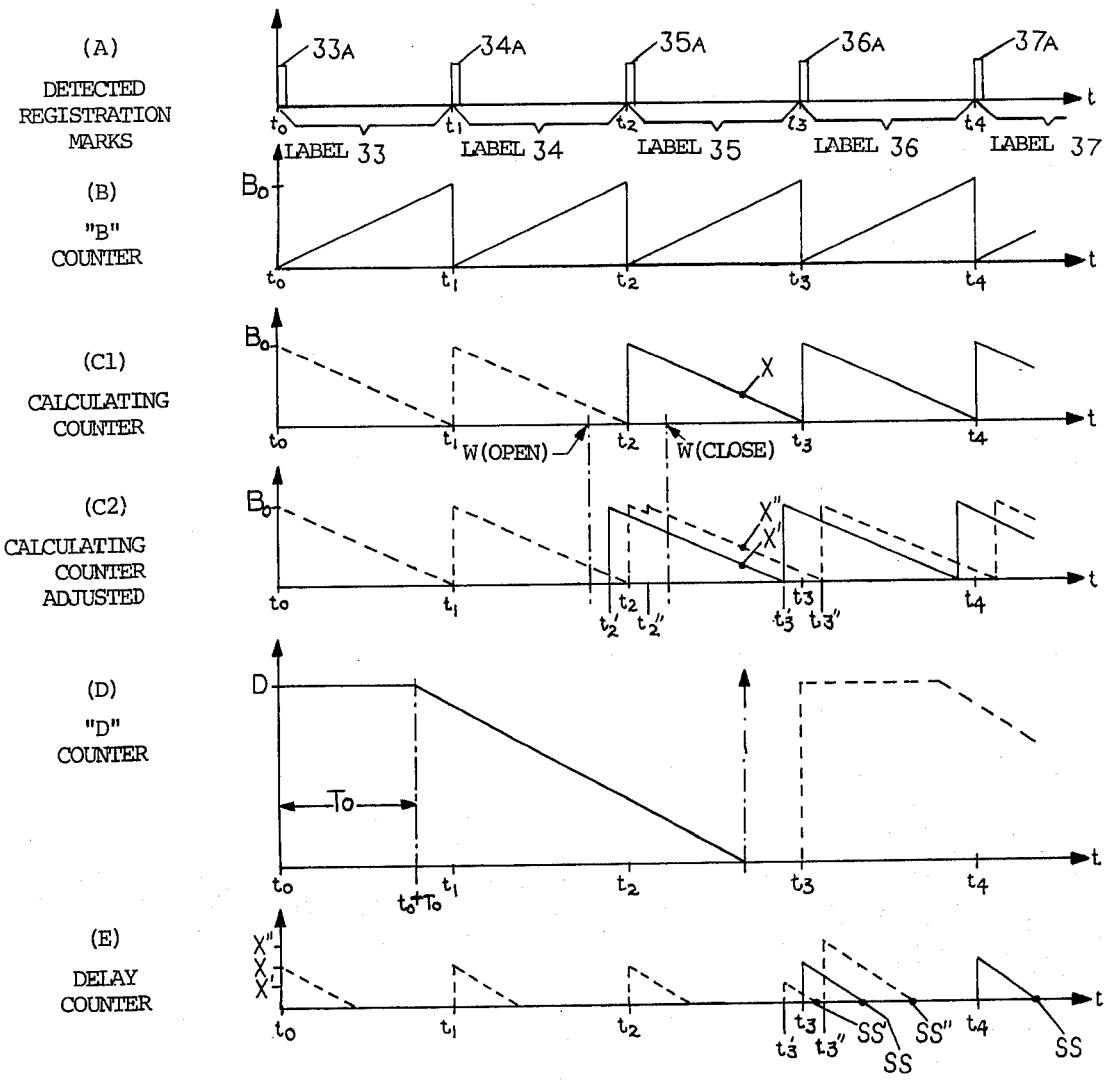
FIGS. 3(A)–3(E) are a series of graphs illustrating the relative timing sequence of signals generated within the splice-in-register control of FIG. 1 to generate a splice-command signal SC to the web-feeding machine in accordance with the invention.

Referring now to FIG. 3, the time sequence to generate the splice signal SS is shown. The scanner 38 provides a pulse each time it detects the presence of one of the registration marks 33A through 37A as shown in FIG. 3(A). The control determines the length B of each of the labels 33 through 37 by using a B-counter to tally the number of encoder pulses between successive registration marks as shown in FIG. 3(B), such as, for example, between times $t_1$ and $t_2$. Since a given number of the encoder pulses is proportional to a corresponding length of the moving material 14, the encoder 39 provides the same number of pulses per unit length of material regardless of the speed of the material 14. Therefore, the B-counter measures the length of each label printed on the material 14 independently from the speed of the material 14 through the machine 10. Each time a registration mark is sensed by the scanner 38, the positive-going edge of the pulse first causes the number of encoder pulses tallied by the B-counter to be stored as a length count $B_o$ and then causes thhe B-counter to be reset to zero. For example, at time $t_2$, the positive-going edge of the pulse generated in response to the registration mark 35A first causes the length count $B_o$ tallied by the B-counter from time $t_1$ through $t_2$ to be stored and then causes the B-counter to be reset to zero.

The length count $B_o$ is then loaded into a calculating counter which decrements to zero over the next period that the B-counter increments as shown in FIG. 3(C1). A D-counter is loaded with the value D at the positive-going edge of periodic scanner pulses, such as, for example, at time $t_0$ in response to the pulse generated by the registration mark 33A. The scanner pulses do not affect the D-counter until after it has counted down to zero. After the D-counter reaches zero, it is again loaded with the value D upon the occurrence of the next scanner pulse, such as, for example, at time $t_3$. In any event the D-counter holds the value D for an amount of time equal to the delay time $T_o$ stored in the internal timer of the controller 11. After the delay time $T_o$ has expired, such as, for example, at time $t_o+T_o$, the D-counter decrements to zero. When the D-counter reaches zero, the contemporaneous value tallied in the calculating counter as it decrements is stored as the value X. In this case, for example, the D-counter decrements to zero after time $t_2$ when the registration mark 35A is sensed by the scanner 38. Since the D-counter does not reach zero after each scanner signal, the value X in storage is updated less frequently; in this case, the value X is updated after every third scanner pulse. The first scanner pulse after the D-counter reaches zero causes the value D to again be loaded into the D-counter, as described above, and also causes a delay counter to read the stored value X as illustrated in FIG. 3(E) at time $t_3$. As soon as the value X is read by the delay counter, it begins to decrement to zero. When the counter reaches zero, a splice signal SS is provided. The delay counter reads the same stored value X two more times at the occurrence of successive scanner signals until the stored value X is again updated for three more readings illustrated at times $t_o$, $t_1$, and $t_3$ in FIG. 3(E). The circuitry implementing this method will now be described in more detail.

Figure 4:
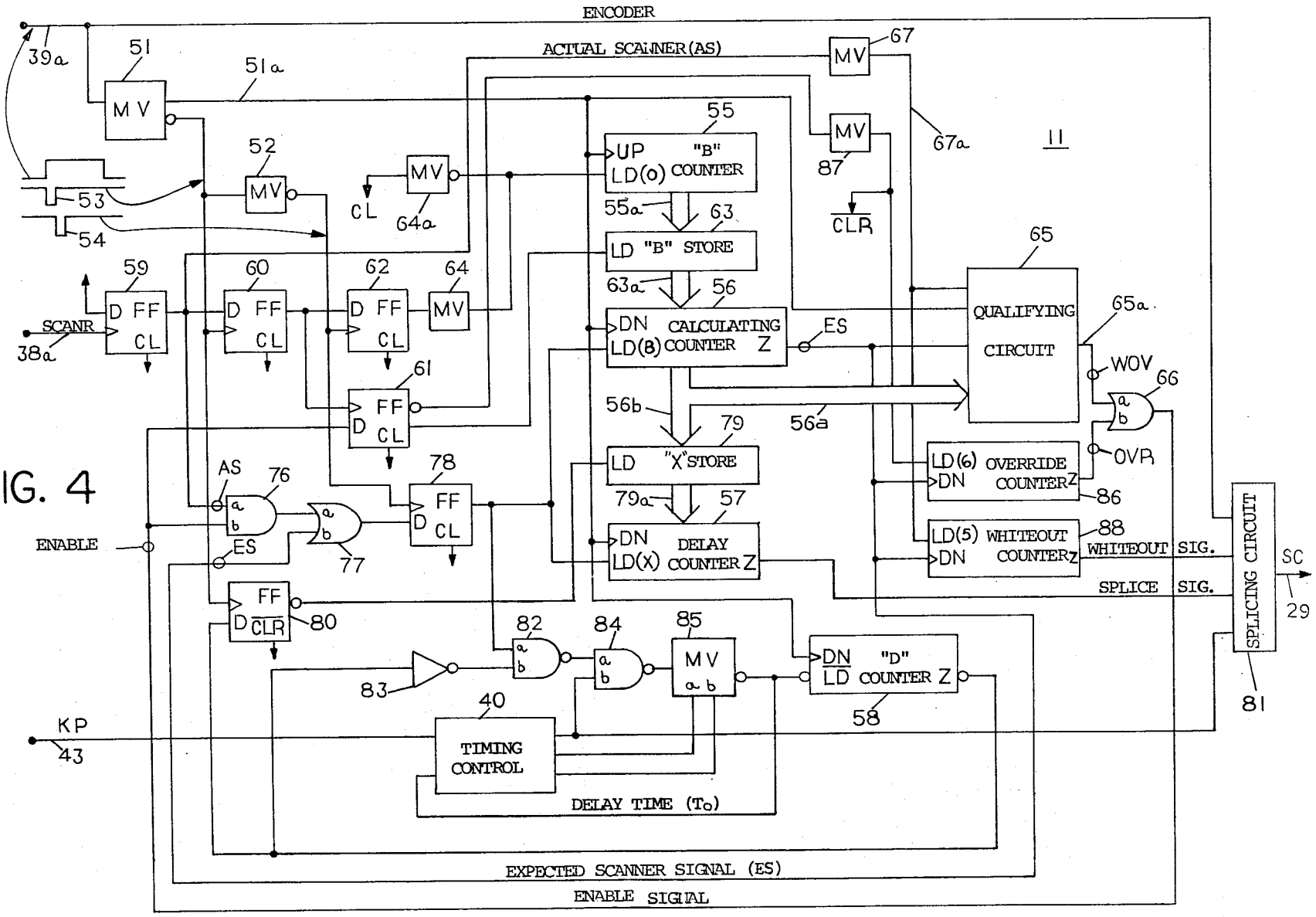
FIG. 4 is an electrical schematic of the splice-in-register control shown in FIG. 1 which comprises a qualifying circuit, a splicing circuit and a timing control in accordance with the invention.

Referring to FIG. 4, an electrical block diagram of the splice-in-register control 11 and the adjust control 40 associated therewith are shown. The output of the encoder 39 is connected via a wire **39*a* to the input of a one-shot multivibrator 51, the complementary output of which is connected to the input of another one-shot multivibrator 52. The multivibrators 51 and 52 are driven by the encoder 39 to function as a first and second timer, respectively, providing sequential pulses 53 and 54, respectively, beginning at the leading edge of each encoder pulse. These pulses 53 and 54 provide properly timed loading, storing and zeroing of the circuit components. The one-shot 51 also provides clocking from its normal output along a conductor 51*a* to the clock inputs of the B-counter 55, the calculating counter 56, the delay counter 57 and the D-counter 58, all of which were referred to above. The B-counter 55** increments, while the other counters decrement from predetermined or derived values and stop upon reaching zero.

The scanner 38 is connected to the clock input of a D-type flip flop 59 via the conductor 38. When the scanner 38 provides a pulse in response to the presence of a registration mark, the normal output of the flip flop 59 goes high at the positive-going edge of the scanner pulse to provide a "actual scanner" signal AS since the data input of the flip flop is always held high. The normal output of the flip flop 59 is connected to the data input of another D-type flip flop 60. This flip flop 60 is clocked by the output of the first one-shot 51 to synchronize the scanner pulse with the encoder pulses. Thus, the normal output of the flip flop 60 provides a synchronized scanner signal in phase with the next encoder pulse. The synchronized scanner signal is applied to both the clock input of a D-type flip flop 61 and the data input of a D-type flip flop 62 which is clocked by the second one-shot 52. The normal output of the flip flop 61 is connected to the load input of a B-storage register 63 and the normal output of the flip flop 62 is to a one-shot multivibrator 64, the output of which is connected to the load input of the B-counter 55 which is preset to zero and the input of a one-shot multivibrator **64*a*. The multivibrator 64*a* clears the flip flops 59, 60, 61 and 62 at the clear input CL of each. Thus, the length count $B_o$ is conditionally loaded into the B-storage register 63 via a bus 55*a* before the B-counter 45 is zeroed. However, a new length count $B_o$ will not be loaded into the B-storage register 63 unless the data input of the flip flop 61 is held high in response to a satisfied condition. The condition requires that the registration mark be detected approximately where it was "expected", i.e., within a "window" that opens a predetermined number of counts, or a predetermined distance, before the calculating counter 56 decrements to zero and then closes a predetermined number of counts after the calculating counter 56 reaches zero. If five successive registration marks are not detected in the window where "expected," a whiteout condition has occurred as defined above. The window is illustrated in FIG. 3** (Cl) as beginning before the expected time $t_2$ at a time indicated by W(OPEN) and ending after the expected time $t_2$ at a time indicated by W(CLOSE).

Figure 5:
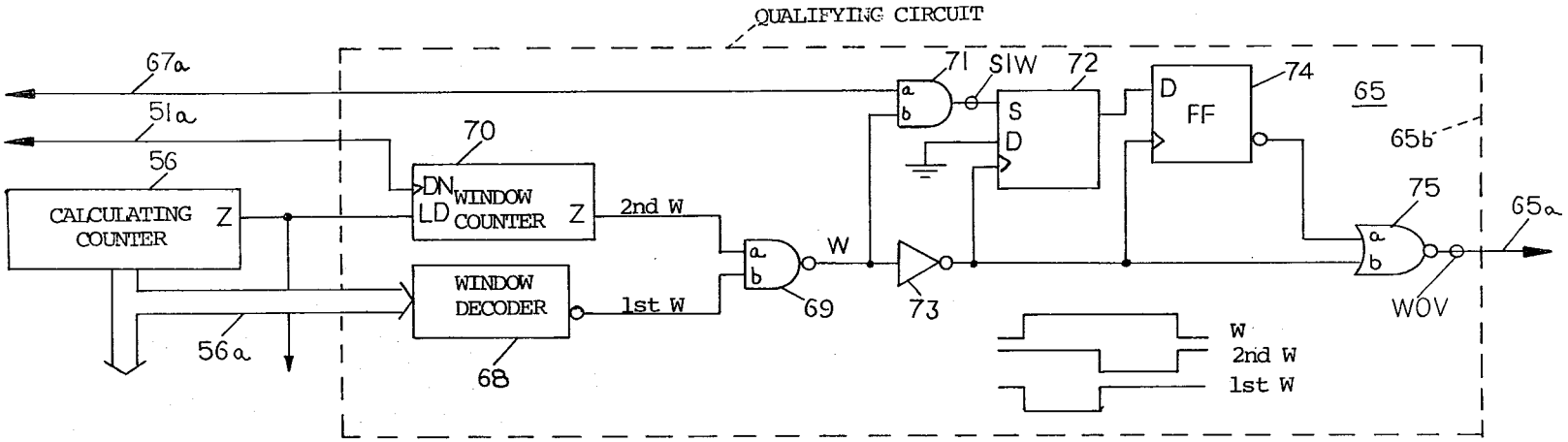
FIG. 5 is an electrical schematic of the qualifying circuit shown as a block in FIG. 4 in accordance with the invention.

Whether or not a registration mark is detected in the window is determined by a qualifying circuit 65, the output of which is provided along a conductor **65*a* to an input 57*a* of an OR gate 66. The output of the OR gate 66 is applied to the data input of the condition-loading flip flop 61. The qualifying circuit 65 receives inputs from the first one-shot 51 along the conductor 51*a*, the zero output and the data bus 56*a* of the calculating counter 56, and the normal output of a one-shot multivibrator 67 along a conductor 67*a*. The input of the multivibrator 67 is connected to the normal output of the flip flop 59 and therefore if responsive to the actual scanner signal AS. Referring in more detail to FIG. 5, the qualifying circuit 65 is shown within a dash line 65*b*. The data bus 56*a* is connected to the input of a decoder 68, the complementary output of which is connected to the input 69*b* of a NAND gate 69. The zero output is the calculating counter 56 is connected to the load input of a window counter 70 which is decrementally clocked by the first one shot 51 via the conductor 51*a*. The counter 70 counts down from its preset value and stops counting when it reaches zero. The zero output of the window counter 70 is connected to the other input 69*a* of the NAND gate 69. When the calculating counter 56** decrements to and contains a value lower than a specific number preset in the window decoder 68, the complementary output of the window decoder 68 goes low to open the window at the time W(OPEN). This low signal 1stW, represents the first portion of the window after the window opened and remains low until the calculating counter 56 decrements to zero. As soon as the calculating counter 56 reaches zero, the window counter 70 is loaded with a predetermined number corresponding to the second portion of the window and begins to decrement therefrom. Thus, the zero output of the window counter 70 provides a low signal, 2ndW, at the same time the complementary output of the window decoder 68 goes high. This is represented in FIG. 3(C1) as the expected time $t_2$. However, after the window counter 70 decrements and reaches zero, the zero output goes high to close the window at the time W(CLOSE). Therefore, as long as either of the inputs 69*a* or 69*b* of the NAND gate 69 are held low, the output of the NAND gate 69 provides a high signal, W, indicating that the window is open. This sequence is also illustrated in FIG. 3 (C1).

The normal output of the multivibrator 67 is connected via the wire 67*a* to an input 71*a* of an AND gate 71, the other input 71*b* of which is connected to the output of the NAND gate 69. Whenever an actual scanner signal AS is presented to the AND gate 71 along with the window signal W, the registration mark is considered to be detected within the window. In such case, the output of the AND gate 71 goes low to provide a "scanner-in-window" of SIW signal which is presented to the set input of a D-type flip flop 72 causing its normal output which was reset at the close of the previous window, to go high. The output of the NAND gate 69 is also connected to the input of an inverter 73, the output of which is connected to the clock input of the flip flop 72, the clock input of a D-type flip flop 74 and the input 75*b* of a NOR gate 75. The data input of the flip flop 74 is connected to the normal output of the flip flop 72 and the complementary output of a flip flop 74 is connected to the other input 75*a* of the NOR gate 75. When the window is open and the actual scanner signal AS is detected therein to provide a SIW signal, the normal output of the flip flop 72 applies a high signal to the data input of the flip flop 74. When the window closes, the output of the inverter 73 goes high setting the flip flop 74 so that its complementary output goes low and then clearing the flip flop 72. In such cases, setting the flip flop 74 effectively causes the SIW signal to be stored therein. However, even though the registration mark is detected within the current window W, a high signal on the conductor 65*a* will not appear until the next window W' opens. This is true because the set state of the flip flop 72 will not have been transferred to the flip flop 74 for storage until the end of the current window W and no high signal on conductor 65*a* can appear outside the window as required by the NOR gate 75. When the next window W' opens, the inverter 73 goes low enabling the stored SIW signal from the complementary output of the flip flop 74 so that the NOR gate 75 provides a high signal or a "window open & valid" signal WOV along the conductor 65*a*. Correspondingly, if a registration mark is not detected in the current window W, the flip flop 74 will not be set when the current window W closes so that its complementary output remains high permitting no WOV signal during the next window W' which inhibits the storing of the number $B_o$. Hence, if a registration mark is not detected, there will be no WOV signal in the next window W'.

Therefore, referring back to FIG. 4, if a WOV signal is presented along the conductor wire 65*a* to the OR gate 66, it will provide a high signal or enable signal to the data input of the condition-loaded flip flop 61. Therefore, when a synchronized scanner signal is applied to the clock input of the flip flop 61 after the enable signal has been applied to the data input, the most recent length count $B_o$ will be loaded into the B-storage register 63. When a WOV signal is present as such, the mode of operation is referred to as the normal mode. The normal mode is the first of three modes of operation, the second being a free-wheeling mode and the third being an override mode, both of which will be discussed below. Returning to the discussion of the normal mode, the output of the OR gate 66 is also connected to the input 76*b* of a AND gate 76, the other input 76*a* of which is connected to the normal output of the flip flop 59 which provides the actual scanner signal AS thereto. The output of the AND gate 76 is connected to the input 77*a* of an OR gate 77, the output of which is connected to the data input of a flip flop 78 clocked by the second one-shot 52 and cleared by the one-shot 64*a*. The normal output of the flip flop 78 is connected to the load inputs of the calculating counter 56 and the delay counter 57, both of which begin to decrement after being loaded. Therefore, when both an actual scanner signal AS and an enable signal resulting from a WOV signal are presented to the AND gate 76, the calculating counter 56 will be updated with the most recent, valid length count $B_o$ stored in the B-storage register 63 as presented along a data bus 63*a* therefrom. The delay counter 57 is simultaneously loaded with a derived value stored in a register 79 as presented along a data bus 79*a* therefrom. The derived value stored in the register 79 is the value X, the distance or number of pulses between the center line of the scanner 38 and the last registration mark sensed by the scanner 38 at the time when the D-counter 58 reaches zero. As described above, when the D-counter 58 reaches zero, the contemporaneous value tallied in the calculating counter 56 is the value X which is subsequently stored in the X-register 79. Referring in more detail to the embodiment, the complementary zero output of the D-counter 58, when the D-counter 58 reaches zero, provides a low signal to the data input of D-type flip flop 80 being clocked at its clock input by the first one-shot 51. When this occurs, the complementary output of the flip flop 80 provides a high signal for the load input of the X-register 79 which reads and stores the contemporaneous value X therein as provided by the calculating counter 56 along a data bus 56*a* connected in parallel with the data bus 56*a*. After the delay counter 57 is loaded with the value X, it decrements to zero. When it reaches zero, its normal zero output provides the splice signal SS to a splicing circuit 81.

The normal output of the flip flop 78, which is set by the occurrence of an actual scanner signal AS and an enable signal resulting from a WOV signal as described above, is connected to an input 82*a* of a NAND gate 82. The complementary zero output of the D-counter 58 is also connected to an inverter 83, the output of which is connected to the other input 82*b* of the NAND gate 82. The output of the NAND gate 82 is connected to an input 84*a* of another NAND gate 84, the output of which is connected to the input of a one-shot multivibrator 85. The complementary output of the multivibrator 85 is connected to the inverted load input of the D-counter 58. The multivibrator 85 is the internal timer of the control 11 that was referred to hereinabove and is triggered through the NAND gates 82 and 84 by the flip flop 78 to provide an inverted pulse having a time period which is to the time delay $T_o$. This inverted pulse continuously loads the D-counter 58 with the value D which forces the D-counter 58 to remain in the D-state until the pulse is removed. When the internal timer 85 times out, the D-counter 58 begins to decrement. When the D-counter 58 reaches zero, the complementary zero output thereof goes low causing the X register 79 to be updated by the calculating counter 56 as described above.

In the normal mode, the registration mark is expected at the time $t_2$ as illusted in FIG. 3. Nevertheless, the qualifying circuit 65 is also self-adjusting in that it will synchronize the length count $B_o$ to be in phase with the actual scanner signal AS by ignoring the expected time $t_2$ at which the calculating counter 56 reaches zero. For example, if the actual scanner signal AS occurs in the first part of the window, 1stW, at a time $t_2'$, the calculating counter 56 is reloaded before reaching zero as illustrated in FIG. 3(C2). In such case, the calculating counter 56 decrements for a greater period of time before the D-counter reaches zero so that the X-register 79 is updated with a value X' of a lesser magnitude than that of the value X. Furthermore, the calculating counter 56 reaches zero at an earlier time $t_3'$. The net effect is that the delay counter 57 is loaded at the earlier time $t_3'$ with a smaller value X'. Because of this, not only is the phase adjusted, but also the timing of the splice signal SS itself which occurs at an earlier time SS' as illustrated in FIG. 3(E). If, on the other hand, the actual scanner signal AS occurs in the second part of the window, 2ndW, at a later time $t_2''$ than expected, the X-register 69 is updated with a greater value X'' which ultimately causes a phase change in the opposite direction to a later time $t_3''$ resulting in a later splice signal SS''.

The freewheeling mode commences when no enable signal resulting from a WOV signal is applied to set the flip flop 61 because of the failure to detect a registration mark in the preceding window. In such case, the value of the length count $B_o'$ in the B-counter 55 is invalid and disregarded because the B-counter 55 had not been previously zeroed. As a result, the invalid length count $B_o'$ is not used and is not loaded into B-storage register 63 which still contains a previous length count $B_o$ that is valid. This previous, valid length count $B_o$, rather than the invalid length count $B'_o$, is loaded into the calculating counter 56 when it reaches zero, The zero output of the calculating counter 56 is also connected to the other input 77*b* of the OR gate 77. Thus, the flip flop 78 is set by high signal or "expected scanner" signal ES, even in the absence of an actual scanner signal AS and an enable signal resulting from a WOV signal at a time when the registration mark was "expected", for example, at the time $t_2$ as shown in FIG. 3(C1). Essentially, the expected-scanner signal ES keeps the control 11 operating in a freewheeling mode despite the lack of contemporaneous WOV and scanner signals by ignoring the invalid length count $B_o'$, reloading the calculating counter 56 and the delay counter 59, and, when appropriate, retriggering the internal time 85.

The override mode begins when a predetermined number of registration marks are missed by the scanner 38. The zero output of the calculating counter 56 is also connected to the decrementing clock input of an override counter 86 which stops decrementing upon reaching zero. The zero output of the override counter 86 is connected to the other input 66*b* of the OR gate 66. The complementary output of the flip flop 61 is connected to the input of a one-shot multivibrator 87, the output of which is connected to the load input of the override counter 86. If a first WOV signal is not present because the registration was missing in the previous window, the override counter 86 will decrement. If a second WOV signal is present, the override counter 86 will be reloaded with a predetermined number greater than the whiteout number when a pulse is provided by the multivibrator 87 in response to the flip flop 61 being set. If, however, the second WOV signal is not present because another registration mark was missing, the override counter 86 will again decrement. After a predetermined number of registration marks corresponding to the predetermined number loaded, six in the present embodiment, the override counter 86 reaches zero causing its normal zero output to provide a high signal or an "override" signal OVR to the OR gate 66 which provides the enable signal to the data input of the flip flop 61 until a subsequent registration mark appears. When a subsequent synchronized scanner signal sets the flip flop 61 because the enable signal is again being applied to the data input of the flip flop 61, the B-storage register 63 is updated by the B-counter 55 and the override counter 86 is again loaded causing a return to the normal mode. The circuitry associated with the override mode is necessary to permit the counters to align with the registration marks on the labels as the machine 10 starts up or after severe slippage occurs in the encoder roller 17 causing the counters and registration marks to be out of phase.

The output of the multivibrator 67 also provides the actual scanner signal AS to the load input of a whiteout counter 88 having a decrementing clock input connected to the zero output of the calculating counter 56. The output of the whiteout counter 88 is connected to the splicing circuit 81. As long as actual scanner signals AS are being provided by the scanner 38, the whiteout counter 88 will be reloaded and will not decrement. However, after a predetermined number of freewheeling cycles with no registration marks detected, the whiteout counter 88 is decremented to zero by the calculating counter 56 to provide a high signal or a "whiteout" signal WO to the splicing circuit 81.

Figure 6:
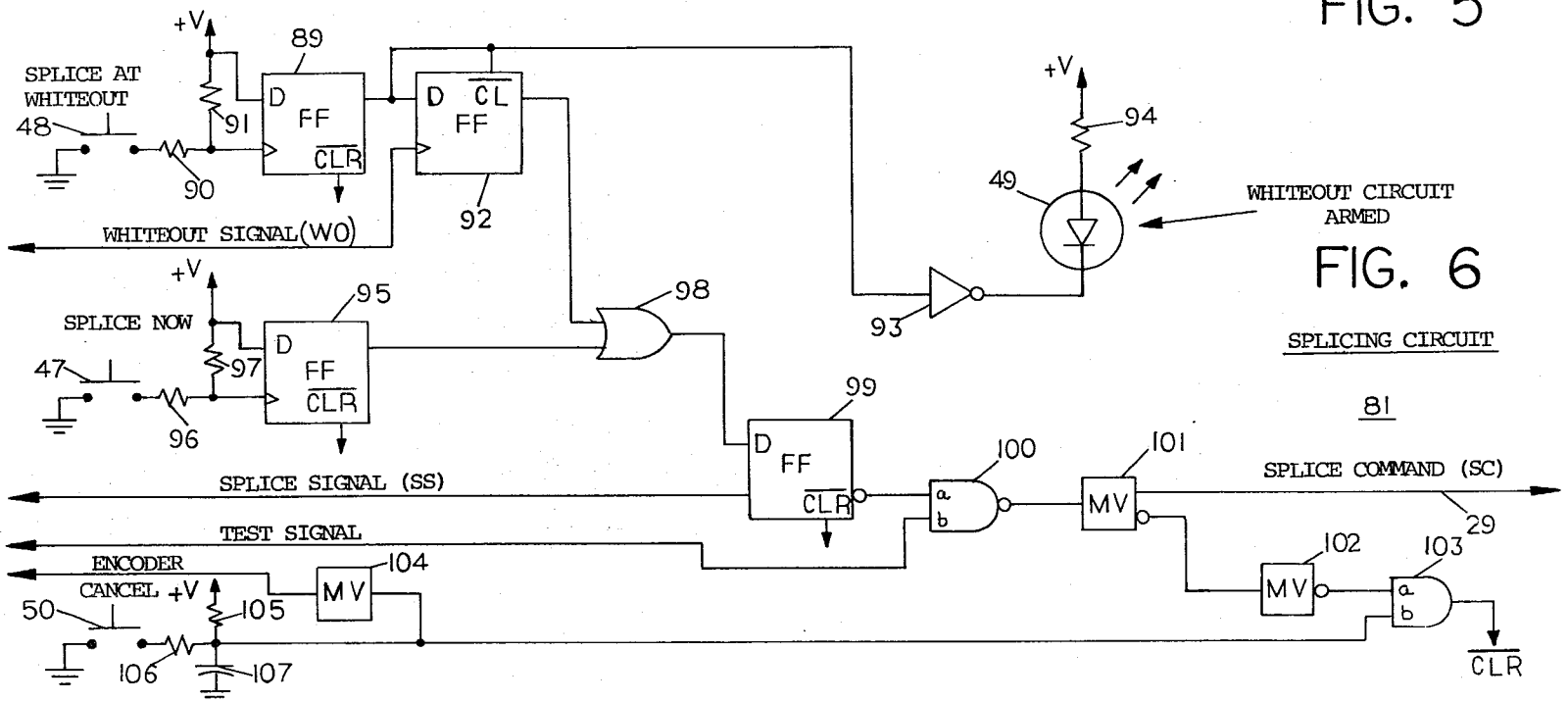
FIG. 6 is an electrical schematic of the splicing circuit shown as a block in FIG. 4 in accordance with the invention.

Referring in more detail to FIG. 6, the splicing circuit 81 comprises a whiteout circuit, a splice-now circuit and a cancel circuit. The whiteout circuit comprises a D-type flip flop 89 having its clock input connected to resistors 90 and 91 and its data input connected to the other end of the resistor 9 and a source of positive voltage V. The other end of the resistor is connected to the grounded splice-at-whiteout switch 48. The whiteout circuit further comprises another D-type flip flop 92 having its clock input connected to the whiteout counter 88 and its data input connected to the normal output of the flip flop 89, its inverted clear CL input and an inverter 93. The other end of the inverter 93 is connected to the cathode of the light-emitting diode 49, the anode of which is connected to a source of positive voltage V through a resistor 94. The splice-now circuit comprises another D-type flip flop 95 having its clock input connected to the junction of resistors 96 and 97 and its data input connected to the other end of the resistor 96 and a source of positive voltage V. The other end of the resistor 96 is connected to the splice-now switch 47, the other end of which is grounded. The normal outputs of the flip flops 92 and 95 are connected to the inputs of an OR gate 98, the output of which is connected to the data input of D-type flip flip 89. The clock input of the flip flop 99 is connected to the normal zero output of the delay counter 57 which provides the splice signal SS. The complementary output of the flip flop 99 is connected to an input 100*a* of a NAND gate 100, the output of which is connected to a one-shot multivibrator 101 which provides the splice-command signal SC along the conductor 29.

As previously discussed, the operator has control over the splice decision signal with which he can determine how the splice-command signal SC is to be triggered by the splice signal SS. The splice signal SS can be gated by either the whiteout circuit or the splice-now circuit through the OR gate 98. If the operator depresses the splice-now switch 47, the next splice signal SS will strobe the flip flop 99 to trigger the splice-command signal SC. If the operator depresses the slice-at-whiteout switch 48, the splice signal SS will strobe the flip flop 99 after the occurrence of a whiteout signal WO precipitated by five successive freewheeling cycles or expected scanner signals with no detected registration marks. The splicing circuit 81 also comprises another one-shot multivibrator 102 having its complementary output connected to an input 103*a* of AND gate 103, the output of which is connected to the inverted clear inputs CLR of the flip flops 89, 99 and 95. The circuit 81 further comprises a retriggerable multivibrator 104 having an input connected to the encoder 39 and an output connected to the other input 103*b* of the AND gate 103, a resistor 105 connected to a source of positive voltage V, a resistor 106 and a grounded capacitor 107. The multivibrator 104 being frequency-sensitive goes low when the frequency of the applied encoder pulses decreases below a known value. The other end of the resistor 106 is connected to the cancel switch 50, the other end of which is grounded. Both inputs of the AND gate 103 are normally high. However, the flip flops 89, 95 and 99 are cleared by the AND gate 103 given any one of three events. The first event is the end of the splice-command signal SC. The complementary output of the multivibrator 101 causes the complementary output of the multivibrator 102 to go low. The second event occurs when the operator depresses the cancel switch 50, whereupon the input 103*b* goes low. The third event occurs when the frequency of the encoder pulses drops below the known value because the speed S of the material 14 through the machine 10 has dropped below its normal range indicating that the machine 10 using the material 14 has stopped and casting doubt on the validity of the encoder and scanner signals.

Figure 7:
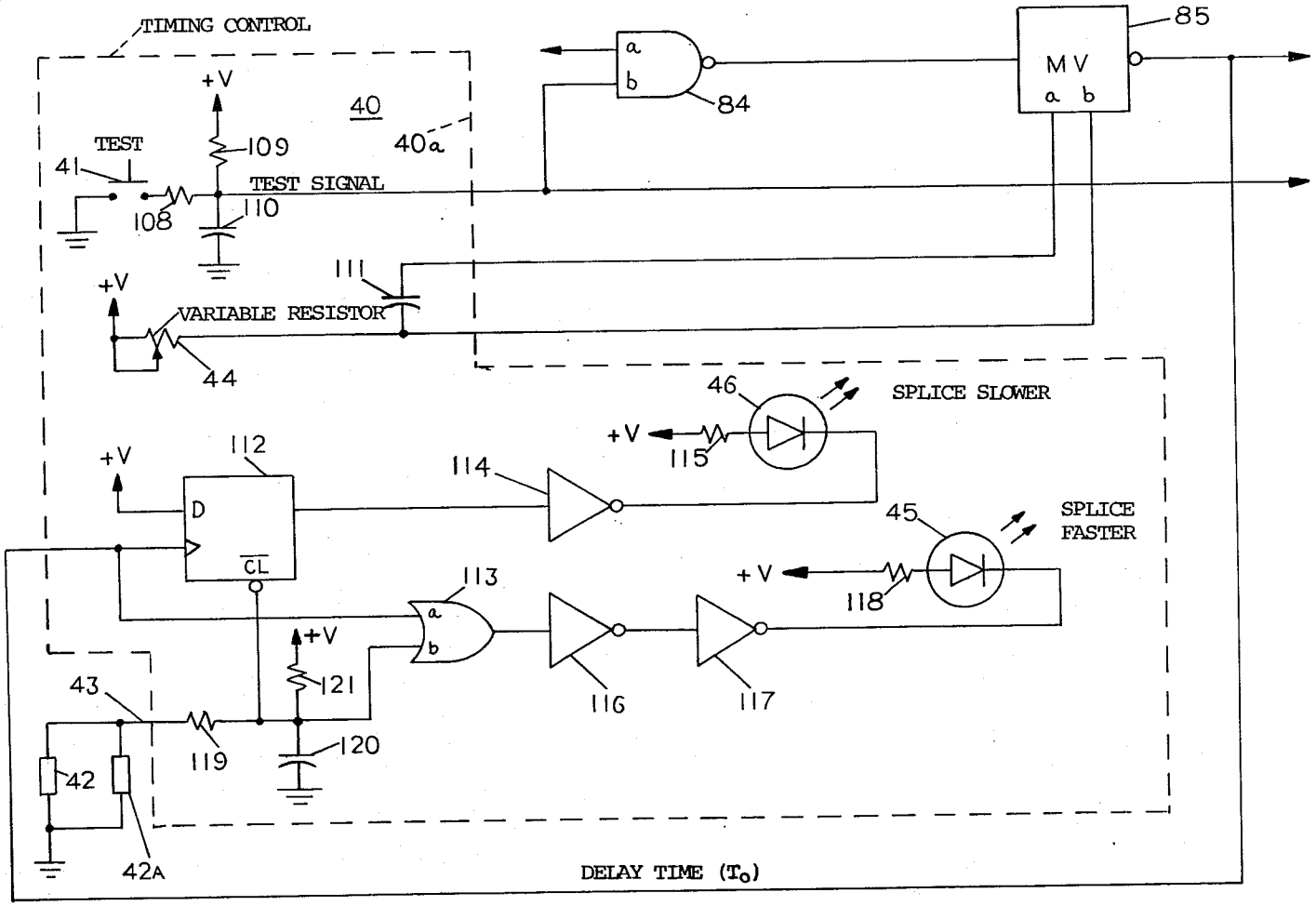
FIG. 7 is an electrical schematic of the timing control shown as a block in FIG. 4 in accordance with the invention.

As described above, the operator can manipulate the timing control 40 to adjust the delay time $T_o$ by depressing the test button 41 and then adjusting the variable resistor 44. Referrring in more detail to FIG. 7, the timing adjust control 40 comprises the components shown in a dashed line 40*a*. The test button 41 has one end grounded and the other end connected to one end of a resistor 108. The other end of the resistor 108 is connected to the junction of a resistor 109 connected to a source of positive voltage V, a grounded capacitor 110, the other input 84*b* of the NAND gate 84, and the other input 100*b* of the NAND gate 100 in the splicing circuit 81. When the test button 41 is depressed, a test signal is simultaneously provided to the NAND gate 84 which triggers the multivibrator or internal timer 85 and to the NAND gate 100 which triggers a splice-command signal SC from the multivibrator 101. The variable resistor 44 has one end and its wiper connected to a source of positive voltage V and the other end connected to the junction of a capacitor 111 and an input 85*b* of the internal timer 85. The other end of the capacitor 111 is connected to an input 85*a* of the internal timer 85. The internal timer 85 provides an inverted pulse which times out after the delay time $T_o$ which must approximate the response time T of the kiss roller 16 as discussed above. The delay time $T_o$ is proportional to the product of the resistance of the variable resistor 44 and the capacitance of the capacitor 111. Therefore, the operator can adjust the delay time $T_o$ so that it more closely approximates the response time T by manipulating the wiper of the variable resistor 44.

This is accomplished by comparing the delay time $T_o$ to the time at which the running kiss roller 16 is fully actuated to the kiss point KP when either of the switches 42 and 42A closes. The complementary output of the internal timer 85 is also connected to the clock input of a D-type flip flop 112 and to an input 113*a* of an OR gate 113. The data input of the flip flop 112 is held high by a source of positive voltage V and its normal output is connected through an inverter 114 to the cathode of the splice-slower light-emitting diode 46, the anode of which is connected through a resistor 115 to a source of positive voltage V. The output of the OR gate 113 is connected through serially connected inverters 116 and 117 to the cathode of the splice-faster light-emitting diode 45, the anode of which is connected through a resistor 118 to a source of positive voltage V. The output of the parallel switches 42 and 42A is connected by the conductor 43 to one end of a resistor 119, the other end of which is connected to the inverted clear input of the flip flop 112, the other input 113*b* of the OR gate 113, a grounded capacitor 120, and another resistor 121 held high by a source of positive voltage V. When either of the switches 42 and 42A closes, a low signal is applied to the input 113*b* of the OR gate 113 and to the inverted clear input of the flip flop 112. If the internal timer 85 has not timed out before either of the switches 42 and 42A closes, the timer will still be providing a low signal to the other input 113*a* of the OR gate 113 so that the splice-faster indicator 45 illuminates. This indicates that the time delay $T_o$ must be decreased so that the timer 85 times out faster. Therefore, the operator must manipulate the variable resistor 44 to decrease the resistance thereof so that the internal timer 85 times out "faster" to be coincident with the response time T. If on the other hand, the internal clock 85 times out before the switches 42 and 42A are closed, the trailing edge of the inverted pulse strobes the flip flop 112 set by the positive voltage on its data input so that the splice-slower indicator 46 illuminates. This indicates that the time delay $T_o$ must be increased so that the timer 85 times out slower. Therefore, the operator must manipulate the variable resistor 44 to increase the reistance thereof so that the interal timer 85 times out "slower" to be coincident with the response time T. In either case, the timing control 40 cycles the light-emitting diodes 46 and 45 with a pulse width proportional to the difference between the delay time $T_o$ and the response time T so that as the difference gets small, neither of the diodes 115 or 118 will appear to be illuminated. Thus, the operator also has an indication as to when the delay time $T_o$ sufficiently coincides with the response time T so that the variable resistor 44 needs no further adjustment.

It will be apparent that various changes will be made in details of construction from those shown in the attached drawings and discussed in conjunction therewith without departing from the spirit and scope of this invention. It is, therefore, to be understood that this invention is not to be limited to the specific details shown and described.

What I claim is:

1. A control system for a web-feeding machine used to provide a continuous supply of material having successive labels and registration marks printed serially thereon, the machine having an assembly for splicing the material from a ready web and the material severed from a running web wherein the response of the assembly after being actuated is delayed by a response time T, the control system comprising:

a driving circuit having an input and an output electromechanically coupled to the splicing assembly actuated thereby in response to a signal applied to the input thereof;

a scanner positioned adjacent the material to provide a signal in response to the presence of a registration mark;

an encoder for providing pulses proportional to a corresponding length of the moving material; and a control circuit connected to said scanner and said encoder, said control circuit having first means for counting the number of encoder pulses $B_o$ between successive scanner signals and then for decrementing the number $B_o$ to zero in response to successive encoder pulses to provide an expected scanner signal ES upon reaching zero, second means responsive to a scanner signal for providing a time delay $T_o$ preset to approximate the response time T and for decrementing to zero from a preset number D corresponding to the distance between the splicing assembly and said scanner after the time delay $T_o$ has expired, third means connected to said first means for storing the decremented value X contained therein when said second means reaches zero and then for decrementing from the value X to zero beginning at the next scanner signal in response to successive encoder pulses to provide a splice signal SS upon reaching zero, and fourth means connected to said third means for providing a splice-command signal SC to the input of said driving circuit in response to the splice signal SS when enabled by an operator, whereby the machine accomplishes a splice-in-register after the splice-command signal SC has been applied thereto.

2. A control system as recited in claim 1 wherein said control circuit further comprises fifth means connected to said first means for providing an enable signal if a scanner signal has been detected in a length-window wherein said first means is responsive to the presence of the enable signal and a scanner signal to use the most recent number $B_o$ and to the absence of the enable signal and a scanner signal to use a previously tallied number $B_o'$, said first means in either case being responsive to the scanner and enable signal combined or the expected-scanner signal ES in the absence of the enable signal to begin decrementing, said second and third means also being responsive to the scanner and enable signal combined or the expected-scanner ES to begin decrementing and triggering, respectively sixth means connected to said first means for decrementing from a preset whiteout number each time said first means provides an expected-scanner signal ES, said sixth means being reloaded with the preset whiteout number in response to a scanner signal, wherein said fourth means is also connected to said sixth means for providing a splice-command signal SC when enabled by the operator and when the said sixth means reaches zero.

3. A control system as recited in claims 1 or 2 further comprising a position-sensing switch responsive to the splicing assembly to close when the splicing assembly has fully actuated to accomplish the splice, and wherein said control circuit further comprises timing control means connected to said position-sensing switch and said second means for comparing the time delay $T_o$ to the response time T and providing an indication of the comparison to the operator, said timing control means being adjustable to change the time delay $T_o$ to more closely approximate the response time T.

4. A control circuit for a web-feeding machine used to provide a continuous supply of material having successive labels and registration marks printed serially thereon, the machine having an assembly for splicing the material from a ready web and the material severed from a running web wherein the response of the assembly after being actuated is delayed by a response time T, a driving circuit having an input and an output electromechanically coupled to the splicing assembly actuated thereby in response to a signal applied to the input thereof, a scanner positioned adjacent the material to provide a signal in response to the presence of a registration mark, and an encoder for providing a fixed number of pulses proportional to a corresponding length of the moving material, the control circuit comprising:

means responsive to the encoder pulses and to the scanner signals for counting the number of encoder pulses $B_o$ between successive scanner signals to determine the length B of each label, said means being zeroed after each scanner signal;

calculating means connected to said B-counting means and responsive to the encoder pulses and to successive scanner signals for reading the number of encoder pulses $B_o$ in response to each scanner signal and then decrementing from the number $B_o$ to zero in response to successive encoder pulses, said calculating means having a data output providing the decrementing number;

timing means responsive to successive scanner signals for providing a time delay $T_o$ preset to approximate the response time T;

means connected to said timing means and responsive to the encoder pulses and to periodic scanner signals for decrementing to zero from a preset number D correspnding to the distance between the splicing assembly and the scanner in response to successive encoder pulses after the time delay $T_o$;

means connected to the data output of said calculating means and responsive to said D-counting means for storing a decremented value X provided at the data output of said calculating means when said D-counting means reaches zero;

delay means connected to said X-storing means and responsive to the encoder pulses and successive scanner pulses for reading the value X in response to a scanner signal, decrementing to zero therefrom in response to successive encoder pulses, and providing a splice signal SS upon reaching zero; and a splicing circuit connected to said delay means, said splicing circuit having an output for providing a splice-command signal SC to the input of the driving circuit and splice-now means for triggering a splice-command signal SC in response to a splice signal SS provided by said delay means after said splice-now means has been armed by an operator, whereby the machine accomplishes a splice-in-register after the splice-command signal SC has been applied.

5. A control circuit for a web-feeding machine used to provide a continuous supply of material having successive labels and registration marks printed serially thereon, the machine having an assembly for splicing the material from a ready web and the material severed from a running web wherein the response of the assembly after being actuated is delayed by a response time T, a driving circuit having an input and an output electromechanically coupled to the splicing assembly actuated thereby in response to a signal applied to the input thereof, a scanner positioned adjacent the material to provide a signal in response to the presence of a registration mark, and an encoder for providing a fixed number of pulses proportional to a corresponding length of the moving material, the control circuit comprising:

means responsive to the encoder pulses and to the scanner signals for counting the number of encoder pulses $B_o$ between successive scanner signals to determine the length B of each label, said means being zeroed after each scanner signal;

means connected to said B-counting means for storing the number of encoder pulses $B_o$ counted said B-storing means being updated by a new number $B_o$ in response to a trigger signal;

calculating means connected to said B-storing means and responsive to the encoder pulses for reading the number of encoder pulses $B_o$ in response to a scanner and enable signal combined or an expected scanner signal ES and then decrementing from $B_o$ to zero in response to successive encoder pulses, said calculating means having a zero output providing an expected scanner signal ES and a data output providing the decrementing number;

timing means responsive to a scanner and enable signal combined or an expected-scanner signal ES for providing a time delay $T_o$ preset to approximate the response time T;

means connected to said timing means and responsive to the encoder pulses and to periodic scanner signals for decrementing to zero from a preset number D corresponding to the distance between the splicing assembly and the scanner in response to successive encoder pulses after the time delay $T_o$;

means connected to the data output of said calculating means and responsive to said D-counting means for storing a decremented value X provided at the data output of said calculating means when said D-counting means reaches zero;

delay means connected to said X-storing means for reading the value X in response to a scanner and enable signal combined or an expected scanner signal ES, decrementing to zero therefrom in response to successive encoder pulses, and providing a splice signal SS upon reaching zero;

qualifying means connected to the outputs of said calculating means and responsive to the encoder pulses and to successive scanner signals for providing a WOV signal after a scanner signal has been detected in a length-window where expected;

logic means connected to said qualifying means for providing an enable signal in response to a WOV signal;

whiteout detecting means connected to the zero output of said calculating means and responsive to successive scanner signals for decrementing from a preset whiteout number in response to successive expected scanner signals ES and providing a whiteout signal upon reaching zero, said whiteout means being reloaded with the preset whiteout number in response to a scanner signal; and a splicing circuit connected to said delay means and said whiteout detecting means, said splicing circuit having an output for providing a splice-command signal SC to the input of the driving circuit, splice-now means for triggering a splice-command signal SC in response to a splice signal SS provided by said delay means after said splice-now means has been armed by an operator, and splice-at-whiteout means for triggering a splice-command signal SC in response to a whiteout signal provided by said whiteout detecting means after said splice-at-whiteout means has been armed by the operator, whereby the machine accomplishes a slice-in-register after the splice-command signal SC has been applied thereto.

6. A control circuit as recited in claim 5 wherein said qualifying means further comprises decoding means connected to the data output of said calculating means for providing a signal representing a first portion of the window (1stW) over a range of counts beginning when said calculating means decrements to a first predetermined number and ending when said calculating means reaches zero, counting means connected to the zero output of said calculating means and responsive to the encoder pulses for providing a signal representing a second portion of the window (2ndW) over a range of counts beginning when said calculating means reaches zero to provide an expected-scanner signal ES and load said counting means with a second predetermined number and ending when said counting means decrements in response to successive encoder pulses to reach zero, first logic means connected to said decoding means and said counting means for providing a window signal W in response to the presence of either the 1stW signal or the 2ndW signal, second logic means for providing a scanner-in-window signal SIW in response to both a current window signal W from said first logic means and a scanner signal, means connected to said second logic means for storing the SIW signal, and means connected to said immediately preceding storage means and said first logic means for providing a WOV signal in response to the presence of both a stored SIW signal and the next window-signal W.

7. A control circuit as recited in claim 5 further comprising override means connected to the zero output of said calculating means and responsive to successive scanner and enable signals combined for decrementing from a preset override number greater than the whiteout number in response to successive expected scanner signals ES and providing an override signal OVR upon reaching zero, said override means being reloaded with the preset override number in response to a scanner and enable signal combined, and wherein said enable logic means is also connected to said override means for providing an enable signal in response to an override signal OVR whereby the control circuit, at the next scanner signal, operates as if the scanner signals were again appearing in the window.

8. A control circuit as recited in claims 4 or 5 for the machine also having a position-sensing switch coupled to the splicing assembly to close when the splicing assembly has fully actuated to accomplish the splice, wherein said timing means has an input for adjusting the time delay $T_o$ and said control circuit further comprises a timing control circuit having a first input connected to the position-sensing switch and a second input responsive to said timing means, a test output connected to said timing means and said splicing circuit, a time-adjust output connected to the adjust input of said timing means, test means for simultaneously triggering said timing means to initiate a time delay $T_o$ and said splicing circuit to provide a splice-command signal SC after the test means has been actuated by the operator, splice-faster indicating means responsive to the first and second inputs of said timing control circuit for providing an indication that the delay time $T_o$ should be reduced to time-out faster when the time delay $T_o$ expires after the position-sensing switch closes, splice-slower means connected to the first and second input of said timing control circuit for providing an indication that the time delay $T_o$ should be increased to time-out slower when the time delay $T_o$ expires before the position-sensing switch closes, and means connected to the time-adjust output and being adjustable for changing the time delay $T_o$ in response to said splice-faster indicating means or said splice-slower indicating means.

9. A control circuit as recited in claim 8 wherein said splice-faster indicating means and said splice-slower indicating means also provide a visual indication of the deviation between the delay time $T_o$ and the response time T so that the operator can tell when no further adjustment of said timing means is required.

10. A control circuit as recited in claims 4 or 5 further comprising means connected to said splicing circuit and responsive to the encoder pulses for disarming said splice-now means and said splice-at-whiteout means when the frequency of the encoder pulses decreases below a known value.

11. A method for controlling a web-feeding machine used to provide a continuous supply of material having successive labels and registration marks printed serially thereon, the machine having an assembly for splicing the material from a ready web and the material severed from a running web wherein the response of the assembly after being actuated is delayed by a response time T, the method comprising the steps of:

detecting each registration mark with a scanner to provide a signal in response to the presence of a registration mark;

generating a series of pulses with an encoder providing a fixed number of pulses proportional to a corresponding length of the moving material;

counting the number of encoder pulses $B_o$ between successive scanner signals and decrementing from the number $B_o$ to zero in response to successive encoder pulses to provide an expected scanner signal ES upon reaching zero;

providing a time delay $T_o$ preset to approximate the response time T in response to a scanner signal and decrementing to zero from a preset number D, corresponding to the distance between the splicing assembly and the scanner, after the time delay $T_o$ has expired;

storing a decremented value X provided during the step for decrementing from the number $B_o$ when reaching zero during the step for decrementing from the number D;

reading the decremented value X and decrementing therefrom to zero in response to a subsequent scanner signal and successive encoder pulses to provide a splice signal SS upon reaching zero; and providing a splice-command signal SC in response to the splice signal SS when armed by an operator to actuate the splicing assembly, whereby the machine accomplishes a splice-in-register after the splice-command signal SC has been applied thereto.

12. A method as recited in claim 11 further comprising the steps of providing an enable signal if a scanner signal has been detected in a length-window where expected wherein the step for counting the number of pulses $B_o$ decrements from the most recent number $B_o$ in response to the presence of a scanner and enable signal and from a previously tallied number $B_o'$ in response to the absence of a scanner or enable signal, the decrementing in either case beginning in response to the scanner and enable signal combined or the expected-scanner signal ES in the absence thereof, the reading step and the time delay $T_o$ step also beginning in response to the scanner and enable signal combined or the expected-scanner signal ES; decrementing from a preset whiteout number stored in a counter each time an expected scanner signal ES is provided thereto and reloading the counter to restart decrementing from the same preset whiteout number in response to a scanner signal; and providing a splice-command signal SC when the whiteout counter reaches zero after decrementing from the preset whiteout number when armed by the operator.

13. A method as recited in claims 11 or 12 further comprising the steps of sensing the time when the splicing assembly has fully actuated to accomplish the splice to determine the response time T; comparing the time delay $T_o$ to the response time T; and adjusting the time delay $T_o$ to more closely approximate with the response time T.

* * * * *